US009843118B1

(12) United States Patent
Tanaka

(10) Patent No.: US 9,843,118 B1
(45) Date of Patent: Dec. 12, 2017

(54) LOW INSERTION FORCE CONNECTOR

(71) Applicant: Yazaki Corporation, Tokyo (JP)

(72) Inventor: Masahiro Tanaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/637,490

(22) Filed: Jun. 29, 2017

(30) Foreign Application Priority Data

Jul. 19, 2016 (JP) ..... 2016-141182

(51) Int. Cl.
*H01R 13/62* (2006.01)
*H01R 12/82* (2011.01)
*H01R 13/629* (2006.01)
*H01R 13/648* (2006.01)

(52) U.S. Cl.
CPC ..... *H01R 12/82* (2013.01); *H01R 13/62955* (2013.01); *H01R 13/648* (2013.01)

(58) Field of Classification Search
CPC ..... H01R 13/62938; H01R 13/62955; H01R 13/62933
See application file for complete search history.

(56) References Cited

U.S. PATENT DOCUMENTS 9,325,112 B2 * 4/2016 Tabata ..... H01R 13/62905
9,484,668 B2 * 11/2016 Kamei ..... H01R 13/502
9,728,896 B2 * 8/2017 Papurcu ..... H01R 13/641
2004/0266265 A1 * 12/2004 Hayashi ..... H01R 13/5221 439/607.53
2007/0134957 A1 * 6/2007 Mori ..... H01R 13/62933 439/157
2008/0064243 A1 * 3/2008 Okuda ..... H01R 13/62955 439/157
2009/0075506 A1 * 3/2009 Suzuki ..... H01R 13/62938 439/157
2013/0109215 A1 * 5/2013 Kamiya ..... H01R 13/62938 439/338
2013/0224974 A1 * 8/2013 Furuya ..... H01R 13/62938 439/153
2013/0228429 A1 * 9/2013 Henmi ..... H01R 13/62933 200/335

FOREIGN PATENT DOCUMENTS

JP 2005-11647 A 1/2005
JP 2007-149420 A 6/2007

* cited by examiner

*Primary Examiner* — Xuong Chung Trans
(74) *Attorney, Agent, or Firm* — Kenealy Vaidya LLP

(57) ABSTRACT

The lever member includes a rotation fulcrum point portion which is attached to a rotation shaft of a terminal storage body to be rotatable, a lever operation portion which is a force point portion during a lever operation, a fitting operation point portion which performs a fitting operation while sliding a counterpart target guide portion to apply a force between the target guide portion and the fitting operation point portion along with a rotation operation about the rotation fulcrum point portion as a rotation center in response to the rotation operation of the lever operation portion, and a target fixation portion which is fastened to a target fixation portion of a terminal storage body and a counterpart fixation portion after the fitting is completed.

6 Claims, 12 Drawing Sheets

LOW INSERTION FORCE CONNECTOR

CROSS-REFERENCE TO RELATED APPLICATION(S)

The present application claims priority to and incorporates by reference the entire contents of Japanese Patent Application No. 2016-141182 filed in Japan on Jul. 19, 2016.

BACKGROUND OF THE INVENTION

1. Field of the Invention

The present invention relates to a low insertion force connector.

2. Description of the Related Art

Conventionally, there is known a low insertion force connector (a so-called LIF connector) which includes a lever member that is attached to a terminal storage body such as a housing to be rotatable and reduces a fitting operation force of an electrical connection target with respect to a counterpart connector by a rotation operation of the lever member (in Japanese Patent Application Laid-open No. 2007-149420 and No. 2005-11647). For example, in this kind of low insertion force connector, the terminal storage body is fixed to a counterpart part (a counterpart connector or the like) by screw-fixing.

Incidentally, there is a case in which the electrical connection target of the low insertion force connector is, for example, a driving device of a vehicle provided with an inverter or a motor. In this case, there is a possibility that an external force such as a vibration may be transmitted from the driving device to the low insertion force connector. Further, there is also a possibility that an external force is transmitted from an electric wire drawn out from the terminal storage body to the low insertion force connector. Thus, there is a concern that the lever member of the low insertion force connector may rattle with respect to the terminal storage body in accordance with the input of the external force.

SUMMARY OF THE INVENTION

In view of the aforementioned problems, the present invention is to provide a low insertion force connector capable of improving vibration resistance of a lever member.

In order to solve the above mentioned problem and achieve the object, a low insertion force connector according to one aspect of the present invention includes a terminal storage body which a terminal storage portion storing a terminal corresponding to a fitting target with respect to a counterpart terminal of a counterpart connector of an electrical connection target, a connector fitting portion fitted to a counterpart fitting portion of the counterpart connector, and a target fixation portion fixed to a fixation portion of the electrical connection target or the counterpart connector after the fitting of the connector fitting portion and the counterpart fitting portion is completed; and a lever member that includes a rotation fulcrum point portion attached to a rotation shaft of the terminal storage body to be rotatable, a lever operation portion serving as a force point portion during a lever operation, and an operation point portion fitting the terminal to the counterpart terminal while fitting the connector fitting portion to the counterpart fitting portion in a state where a target guide portion of the electrical connection target or the counterpart connector is slid to apply a force between the target guide portion and the operation point portion along with a rotation operation about the rotation fulcrum point portion as a rotation center in response to the rotation operation of the lever operation portion, wherein the lever member includes a target fixation portion which is fastened to the target fixation portion of the terminal storage body and the fixation portion after the fitting is completed.

According to another aspect of the present invention, in the low insertion force connector, it is preferable that the lever member includes the operation point portion and includes a first guide portion guiding the target guide portion along with a rotation operation about the rotation fulcrum point portion as a rotation center, a second guide portion which communicates with the rotation fulcrum point portion and is able to guide the rotation shaft after the completion of the fitting, and a third guide portion which communicates with the first guide portion and is able to guide the target guide portion in the same direction as the rotation shaft after the completion of the fitting, and wherein the second guide portion and the third guide portion are formed so that the lever member moves relative to the terminal storage body to a fastening position of the target fixation portion of the lever member.

According to still another aspect of the present invention, in the low insertion force connector, it is preferable that the second guide portion and the third guide portion are formed to lock the rotation shaft and the target guide portion in a direction intersecting an axial direction of a fastening screw at the time of the fastening when the lever member moves relatively to the fastening position.

According to still another aspect of the present invention, in the low insertion force connector, it is preferable that the terminal storage body includes a positioning portion on which the target fixation portion of the lever member is disposed at the time of the fastening.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
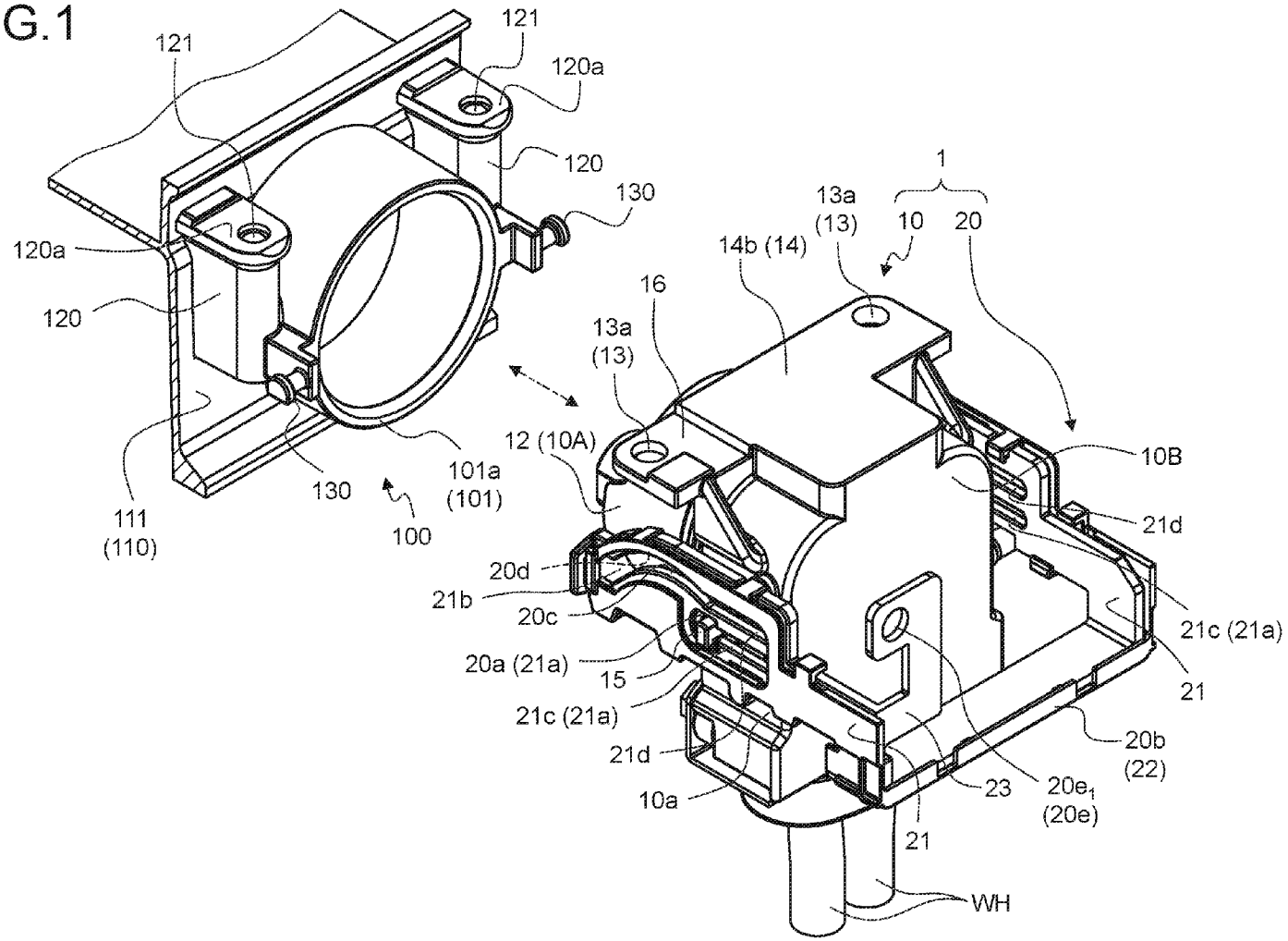
FIG. 1 is a perspective view illustrating a low insertion force connector and a counterpart connector according to an embodiment.

Hereinafter, an embodiment of a low insertion force connector according to the invention will be described in detail with reference to the drawings. Further, the invention is not limited to the embodiment.

Embodiment

An embodiment of a low insertion force connector according to the present invention will be described with reference to FIGS. 1 to 12.

Reference numeral 1 of the drawings denotes the low insertion force connector of the embodiment. The low insertion force connector 1 is physically and electrically connected to a counterpart connector 100 which is a fitting target and includes a terminal (not illustrated), a terminal storage body 10 which stores the terminal, and a lever member 20 that reduces a fitting operation force when the low insertion force connection is fitted to the counterpart connector 100.

The counterpart connector 100 is provided in a device (hereinafter, referred to as an "electrical connection target") 110 which is an electrical connection target using the low insertion force connector 1 and is provided in a casing 111 or the like of the electrical connection target 110 (FIG. 1). The electrical connection target 110 may be anything as long as the electrical connection target uses the low insertion force connector 1. Here, a driving device (for example, a motor or an inverter of an electric vehicle or a hybrid vehicle) of a vehicle is given as an example of the electrical connection target 110. The counterpart connector 100 includes a housing 101 which is provided in the casing 111 of the electrical connection target 110 and a counterpart terminal (not illustrated) is disposed inside a fitting portion (hereinafter, referred to as a "counterpart fitting portion") 101*a* of the housing 101.

In the low insertion force connector 1, the terminal is a fitting target with respect to the counterpart terminal and forms a physical and electrical connection relation in accordance with the fitting. The terminal may be a male terminal or a female terminal.

Figure 2:
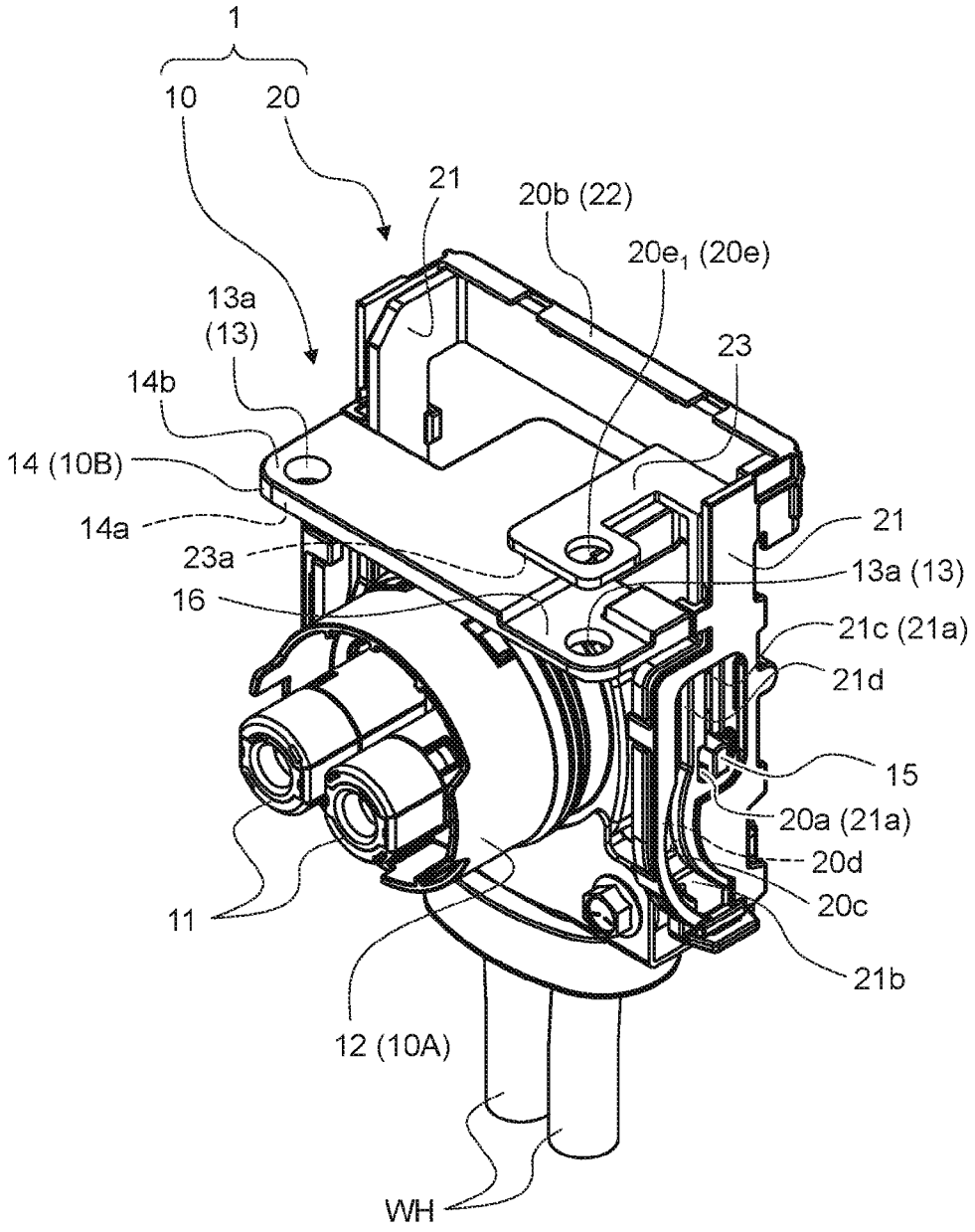
FIG. 2 is a perspective view illustrating the low insertion force connector when a lever member is attached thereto.
Figure 3:
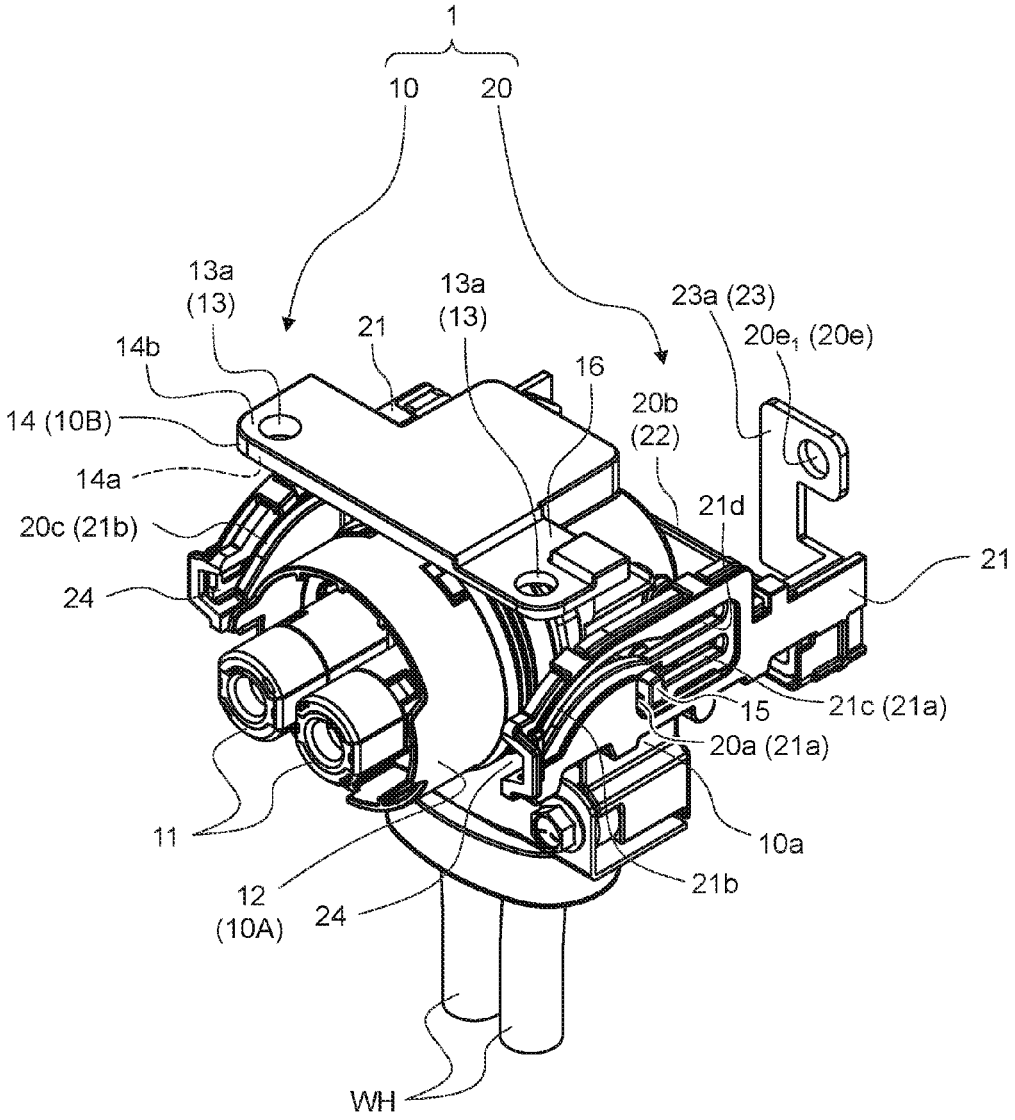
FIG. 3 is a perspective view illustrating the low insertion force connector when the lever member is moved to a first lever position.

The terminal storage body 10 includes a terminal storage portion 11 which stores a terminal and a fitting portion (hereinafter, referred to as a "connector fitting portion") 12 which is fitted to the counterpart fitting portion 101*a* (FIGS. 2 and 3). The terminal storage portion 11 is disposed inside the connector fitting portion 12. In this example, the connector fitting portion 12 and the counterpart fitting portion 101*a* are respectively formed in a cylindrical shape and are fitted to each other along the cylinder axis so that the terminal and the counterpart terminal are fitted to each other. Accordingly, the low insertion force connector 1 and the counterpart connector 100 are physically and electrically connected to each other. In the terminal storage body 10, an electric wire WH which is physically and electrically connected to the inner terminal is drawn out. In this example, the electric wire WH is drawn out in a direction intersecting an insertion/extraction direction (hereinafter, referred to as a "connector insertion/extraction direction") between the connector fitting portion 12 and the counterpart fitting portion 101*a*. Here, the electric wire WH is drawn out in a direction orthogonal to the connector insertion/extraction direction and hereinafter the orthogonal direction will be referred to as a "first orthogonal direction". Further, in the description below, a direction orthogonal to the connector insertion/extraction direction and the first orthogonal direction will be referred to as a "second orthogonal direction".

The low insertion force connector 1 is fixed to the counterpart connector 100 or the electrical connection target 110 after the fitting between the connector fitting portion 12 and the counterpart fitting portion 101*a* is completed. For this reason, the terminal storage body 10 is provided with a target fixation portion 13 used for the fixing. The target fixation portion 13 is fixed to a fixation portion 120 (FIG. 1) of the electrical connection target 110 or the counterpart connector 100 after the fitting between the connector fitting portion 12 and the counterpart fitting portion 101*a* is completed. In this example, two fixation portions 120 are provided at the casing 111 of the electrical connection target 110 and two fixation portions 13 are also provided to match the positions of the fixation portions 120.

The target fixation portion 13 and the fixation portion 120 are fixed by screw-fixing using a fastening screw including a male screw and a female screw. The fastening screw may be, for example, a combination of a male screw member and a female screw member or may include any one of male and female screw members and a threaded portion of a fastening object to be screwed onto the threaded member and a fastening screw threaded to the screw member. For example, each fixation portion 120 is formed as a protrusion body which protrudes toward the low insertion force connector 1 in the cylinder axial direction (the connector insertion/extraction direction) of the counterpart fitting portion 101*a* and the fixation portions 120 are disposed to sandwich the counterpart fitting portion 101*a* in a direction orthogonal to the cylinder axial direction. Each fixation portion 120 is provided with a penetration hole 121 of which an axial direction is the first orthogonal direction. Here, the fixation portions 120 are disposed to be separated from each other in the second orthogonal direction and each fixation portion 120 is provided with the penetration hole 121 of which the axial direction is the first orthogonal direction. The target fixation portion 13 is formed in a piece body shape so that a flat surface overlaps an end surface 120*a* near one opening side of the penetration hole 121 in the fixation portion 120 after the fitting between the connector fitting portion 12 and the counterpart fitting portion 101*a* is completed. The terminal storage body 10 of this example includes a rectangular piece body 14 which protrudes toward the counterpart connector 100 in the cylinder axial direction (the connector insertion/extraction direction) of the connector fitting portion 12 and the piece body 14 is provided with each target fixation portion 13 (FIGS. 2 and 3). Here, since both ends of one flat surface 14*a* of the piece body 14 are fitted to the end surfaces 120*a* of the fixation portions 120 in an overlapping state, both ends of the piece body 14 are respectively used as the target fixation portions 13. Each target fixation portion 13 is provided with a penetration hole 13*a* which is concentric with the penetration hole 121 after the fitting is completed. Here, a shield shell 10B is provided with the target fixation portion 13.

Figure 12:
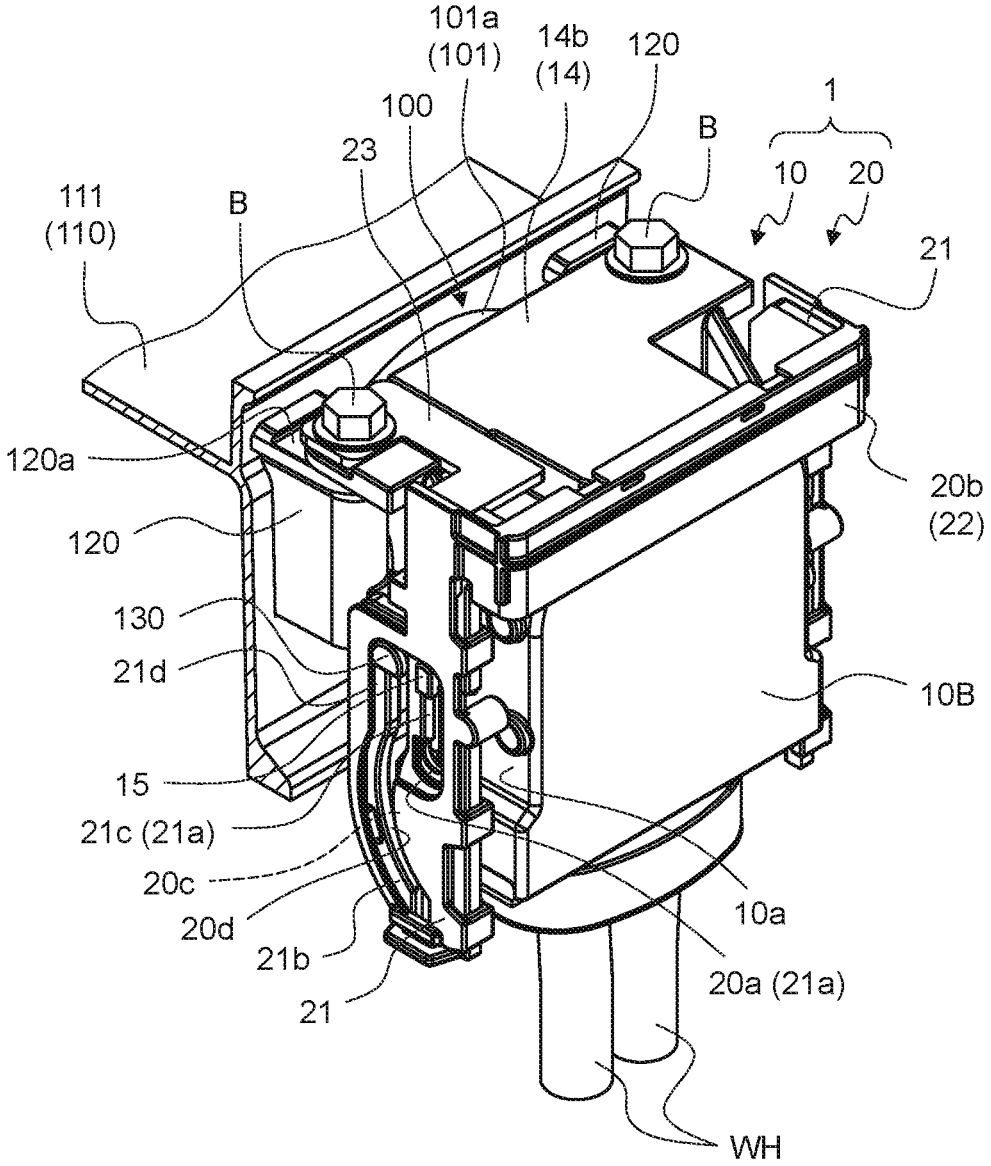
FIG. 12 is a perspective view illustrating a state where a fastening operation for the lever member ends.

For example, the target fixation portion 13 and the fixation portion 120 may be fixed to each other by respectively inserting male screw members (not illustrated) into the penetration holes 13*a* and 121 and threading female screw members (not illustrated) to the male screw members. Further, the target fixation portion 13 and the fixation portion 120 may be fixed to each other by forming a female screw in the inner peripheral wall of the penetration hole 121 and threading a male screw member B inserted through the penetration hole 13*a* to the female screw portion of the penetration hole 121. In this example, the latter case is exemplified (FIG. 12).

Figure 4:
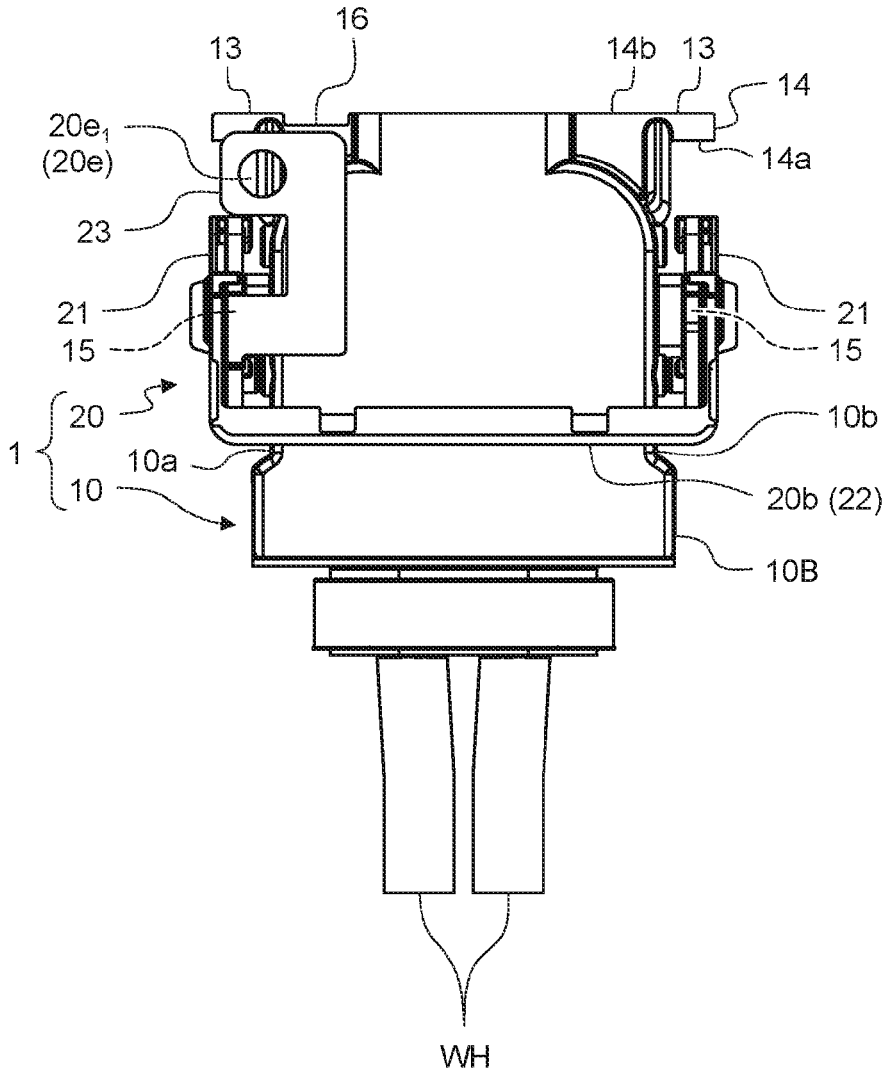
FIG. 4 is a rear view of the low insertion force connector.

Further, the terminal storage body 10 includes a rotation shaft 15 which becomes a rotation center of the lever member 20. The rotation shafts 15 are disposed at two positions to be concentric with the terminal storage body 10 and respectively protrude outward in the opposite directions from the terminal storage body 10. It is assumed that each rotation shaft 15 has an axis following the arrangement direction of the target fixation portions 13. Here, the rotation shafts 15 are disposed so that the axial directions thereof follow the second orthogonal direction. In the terminal storage body 10 of this example, the rotation shafts 15 respectively protrude in the opposite directions from an ends 10*a* and 10*b* in the second orthogonal direction (FIG. 4).

Specifically, the terminal storage body 10 of this example is prepared as an integrated structure in which a housing 10A and the shield shell 10B are assembled.

The housing 10A is obtained by molding an insulating material such as a synthetic resin and is provided with the terminal storage portion 11 and the connector fitting portion 12. The shield shell 10B is provided to cover the housing 10A from the outside for noise countermeasures and is formed of a conductive material such as metal. The target fixation portion 13 and the rotation shaft 15 are provided in at least one of the housing 10A and the shield shell 10B. In this example, the shield shell 10B is provided with the target fixation portion 13 and the rotation shaft 15. For this reason, the shield shell 10B of this example includes the piece body 14 and the ends 10*a* and 10*b*.

The lever member 20 is obtained by molding an insulating material such as a synthetic resin and is attached to the rotation shaft 15 of the terminal storage body 10 to be operated (in the form of a lever rotation) by an operator. As the lever operation, a rotation operation for rotating the lever member 20 relative to the terminal storage body 10 (the shield shell 10B), a pressing operation for linearly moving the lever member 20 relative to the terminal storage body 10 (the shield shell 10B), and a pulling operation for linearly moving the lever member 20 relative to the terminal storage body 10 (the shield shell 10B) in a direction opposite to the pressing operation are performed. Further, the rotation operation is largely divided into a connector fitting rotation operation for fitting the low insertion force connector 1 and the counterpart connector 100 to each other and a connector fitting release rotation operation for releasing the fitting between the low insertion force connector 1 and the counterpart connector 100 in a direction opposite to the connector fitting rotation operation.

Figure 5:
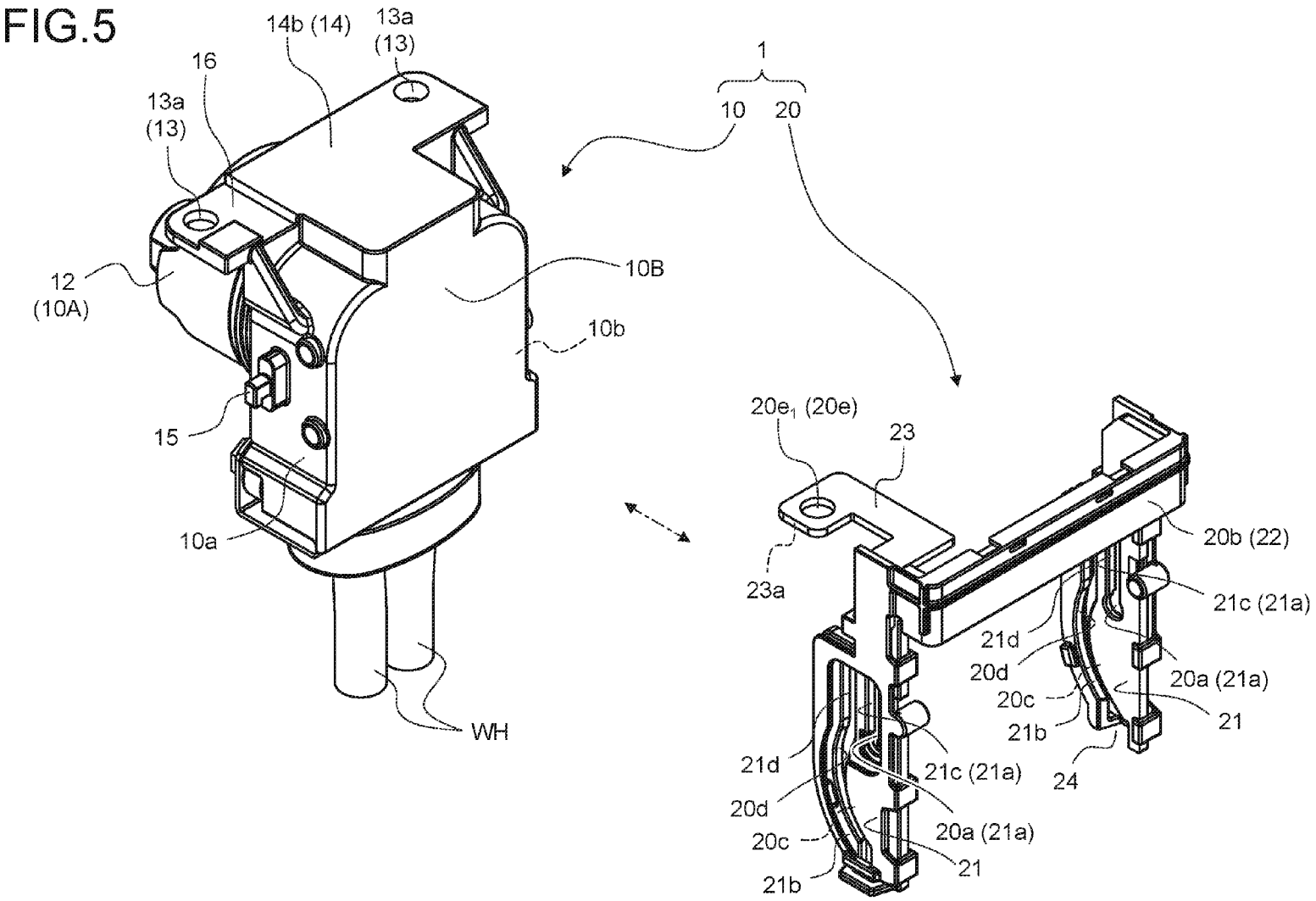
FIG. 5 is an exploded perspective view of the low insertion force connector.
Figure 6:
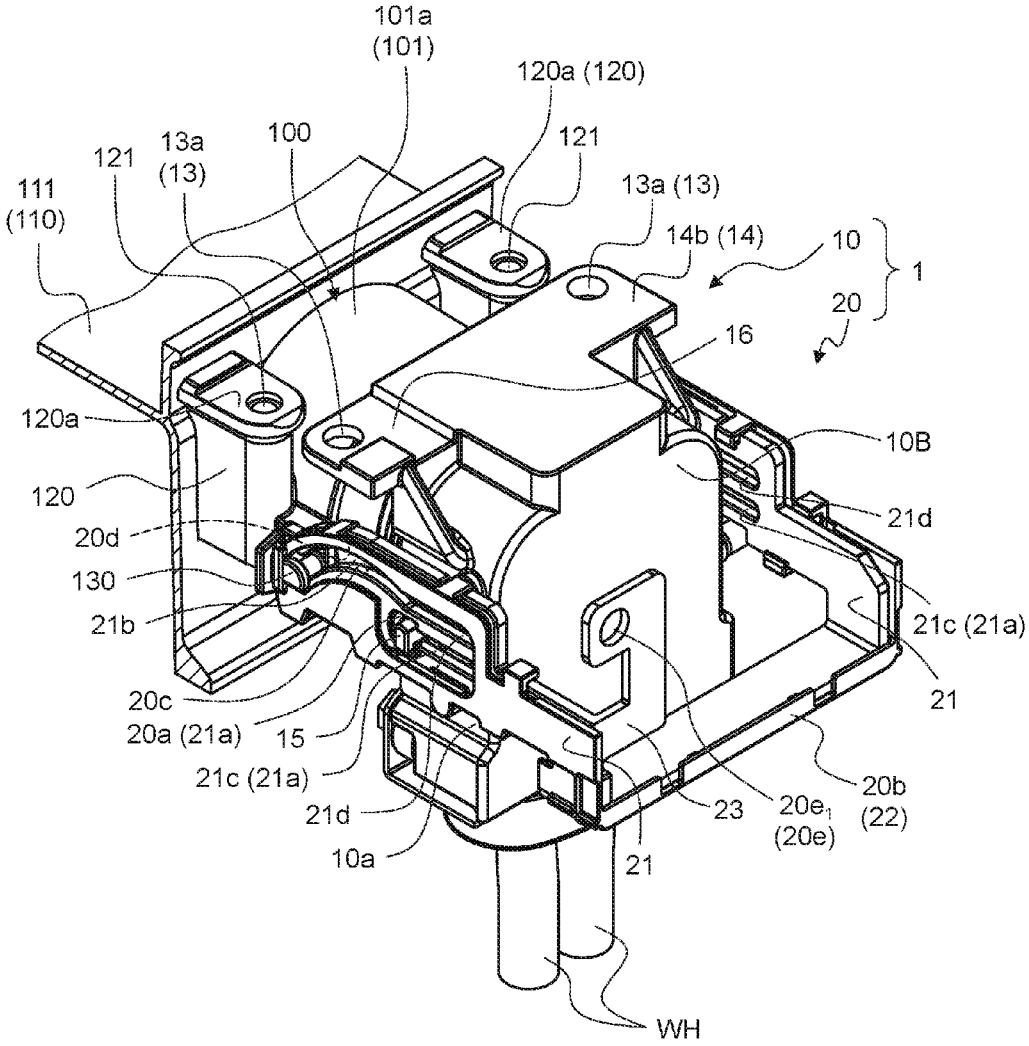
FIG. 6 is a perspective view illustrating a state where a rotation operation for fitting the connector to the lever member does not start and a state where a rotation operation for releasing the fitting of the connector ends.
Figure 7:
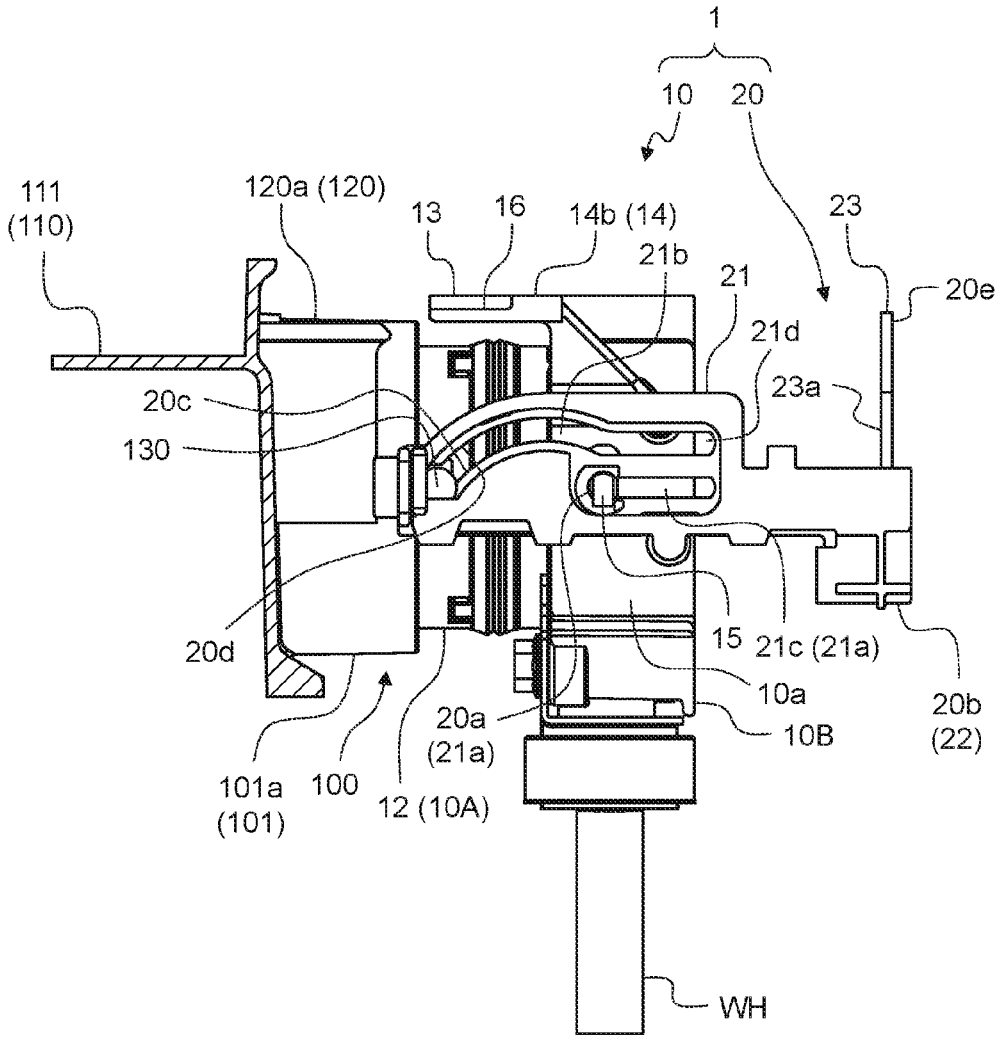
FIG. 7 is a side view illustrating a state where the rotation operation for fitting the connector to the lever member does not start and a state where the rotation operation for releasing the fitting of the connector ends.
Figure 8:
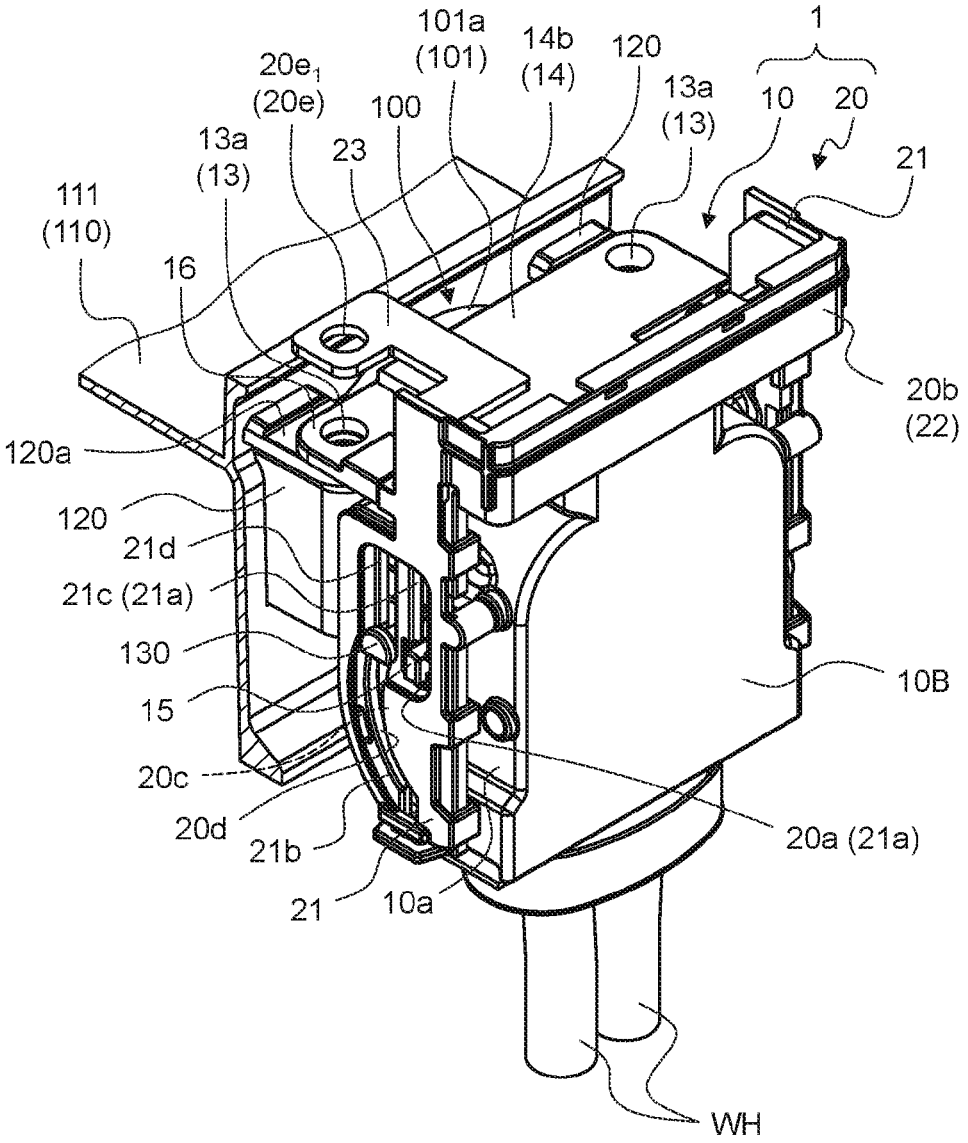
FIG. 8 is a perspective view illustrating a state where the rotation operation for fitting the connector to the lever member ends and the rotation operation for releasing the fitting of the connector does not start.
Figure 9:
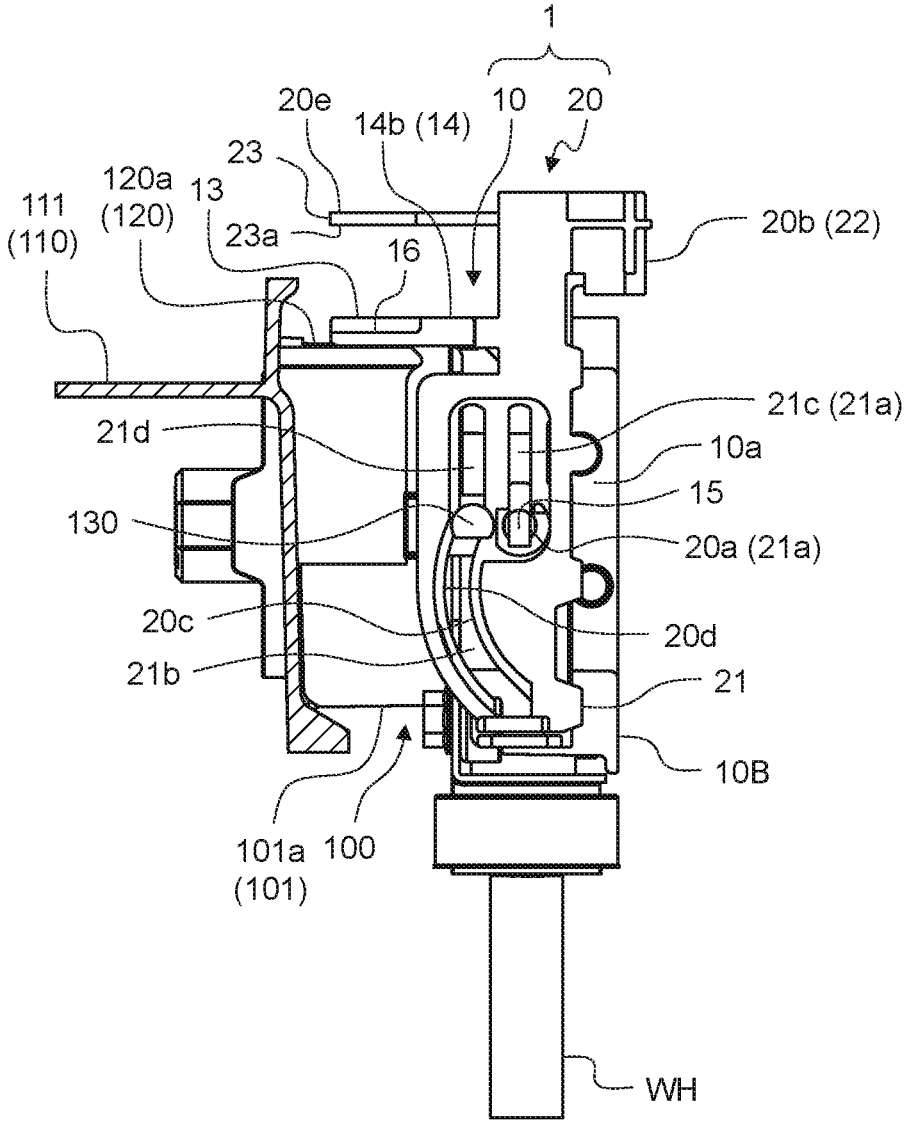
FIG. 9 is a side view illustrating a state where the rotation operation for fitting the connector to the lever member ends and the rotation operation for releasing the fitting of the connector does not start.

The lever member 20 includes a rotation fulcrum point portion 20*a* which is attached to the rotation shaft 15 to be rotatable, a lever operation portion 20*b* which is a force point portion during the lever operation, and an operation point portion (hereinafter, referred to as a "fitting operation point portion") 20*c* which fits the terminal to the counterpart terminal while fitting the connector fitting portion 12 to the counterpart fitting portion 101*a* in a state where a target guide portion 130 of the electrical connection target 110 or the counterpart connector 100 is slid to apply a force between the operation point portion and the target guide portion 130 along with the rotation operation about the rotation fulcrum point portion 20*a* as a rotation center in response to the connector fitting rotation operation of the lever operation portion 20*b* (FIG. 5). Further, the lever member 20 includes an operation point portion (hereinafter, referred to as a "fitting release operation point portion") 20*d* which separates the terminal from the counterpart terminal while separating the connector fitting portion 12 from the counterpart fitting portion 101*a* in a direction opposite to the fitting direction in a state where the target guide portion 130 is slid to apply a force between the operation point portion and the target guide portion 130 along with the rotation operation about the rotation fulcrum point portion 20*a* as a rotation center in response to the connector fitting release rotation operation of the lever operation portion 20*b*. Further, the lever member 20 includes a target fixation portion 20*e* which is fastened to the fixation portion 120 and the target fixation portion 13 of the terminal storage body 10 (the shield shell 10B). The target fixation portion 20*e* is provided in at least one position to be fastened to the fixation portion 120 and the target fixation portion 13 after the fitting of the connector fitting portion 12 and the counterpart fitting portion 101*a* is completed. For this reason, the lever member 20 is fixed to the counterpart connector 100 or the electrical connection target 110 and moves while being interlocked with the movement of the counterpart connector 100 or the electrical connection target 110 along with the terminal storage body 10 even when a vibration is generated in the electrical connection target 110. Thus, since the low insertion force connector 1 can suppress the rattling or relative positional change of the lever member 20 relative to the terminal storage body 10, it is possible to improve the vibration resistance after the fitting is completed.

Specifically, the lever member 20 is molded to be rotatable between a first state position (FIGS. 6 and 7) with respect to the terminal storage body 10 and a second state position (FIGS. 8 and 9) with respect to the terminal storage body 10. The first state position (hereinafter, referred to as a "first lever position") indicates a position where the connector fitting rotation operation starts and a position where the connector fitting release rotation operation ends. Further, the second state position (hereinafter, referred to as a "second lever position") indicates a position where the connector fitting release rotation operation starts and a position where the connector fitting rotation operation ends.

The lever member 20 includes two lever structures 21 which are disposed to be separated from each other in the second orthogonal direction and a connection body 22 which extends in the second orthogonal direction and connects the lever structures 21 to each other (FIG. 5). In the lever member 20, one lever structure 21 is disposed to be separated from one end 10*a* of the terminal storage body 10 (the shield shell 10B) and the other lever structure 21 is disposed to be separated from the other end 10*b* of the terminal storage body 10 (the shield shell 10B). The lever structures 21 extend to ensure a length of a moment arm (that is, a distance between the rotation fulcrum point portion 20*a* and the lever operation portion 20*b*) in response to a target fitting operation force. The connection body 22 is a portion which is used as the lever operation portion 20*b*. The connection body 22 of this example is formed in a piece body shape and connects one ends of the lever structures 21 to each other.

Each lever structure 21 is provided with a groove or a penetration hole into which the rotation shaft 15 is inserted. The penetration hole or the groove is used as the rotation fulcrum point portion 20*a*. The lever structure 21 of this example is provided with a penetration hole 21*a* (FIG. 5). Each lever structure 21 can rotate relative to the terminal storage body 10 about each rotation fulcrum point portion 20*a* as a rotation center by using a part of the penetration hole 21*a* as the rotation fulcrum point portion 20*a*. For this reason, the lever member 20 can rotate relative to the terminal storage body 10 about each rotation fulcrum point portion 20*a* as a rotation center by rotating the connection body 22 (the lever operation portion 20*b*).

Further, each lever structure 21 is provided with a guide portion (hereinafter, referred to as a "first guide portion") 21*b* which guides the target guide portion 130 along with the rotation operation of the lever structure 21 about the rotation fulcrum point portion 20*a* as a rotation center (FIG. 5). The first guide portion 21*b* is provided with a groove or an arcuate penetration hole following the extension direction of the lever structure 21 and the target guide portion 130 is inserted thereinto. Here, the first guide portion 21*b* uses a wall surface contacting the target guide portion 130 during the connector fitting rotation operation among two opposite arcuate wall surfaces as the fitting operation point portion 20*c* and uses a wall surface contacting the target guide portion 130 during the connector fitting release rotation operation as the fitting release operation point portion 20*d*. For this reason, the arcuate wall surface which forms the fitting operation point portion 20*c* is formed in a shape in which a force having a direction and a magnitude necessary for fitting the connector is applied to the target guide portion 130 while the target guide portion 130 is slid along with the rotation operation of the lever structure 21 about the rotation fulcrum point portion 20*a* as a rotation center. Meanwhile, the arcuate wall surface which forms the fitting release operation point portion 20*d* is formed in a shape in which a force having a direction and a magnitude necessary for releasing the fitting of the connector is applied to the target guide portion 130 while the target guide portion 130 is slid along with the rotation operation of the lever structure 21 about the rotation fulcrum point portion 20*a* as a rotation center. The lever member 20 of this example is attached to the terminal storage body 10 so that the extension direction of each lever structure 21 follows the connector insertion/extraction direction at the first lever position and follows the first orthogonal direction at the second lever position and rotates by about 90° relative to the terminal storage body 10 between the first lever position and the second lever position. For this reason, the first guide portion 21*b* of this example is formed to complete the fitting operation and the fitting release operation between the connector fitting portion 12 and the counterpart fitting portion 101*a* within the range of the rotation operation of the lever member 20.

Figure 10:
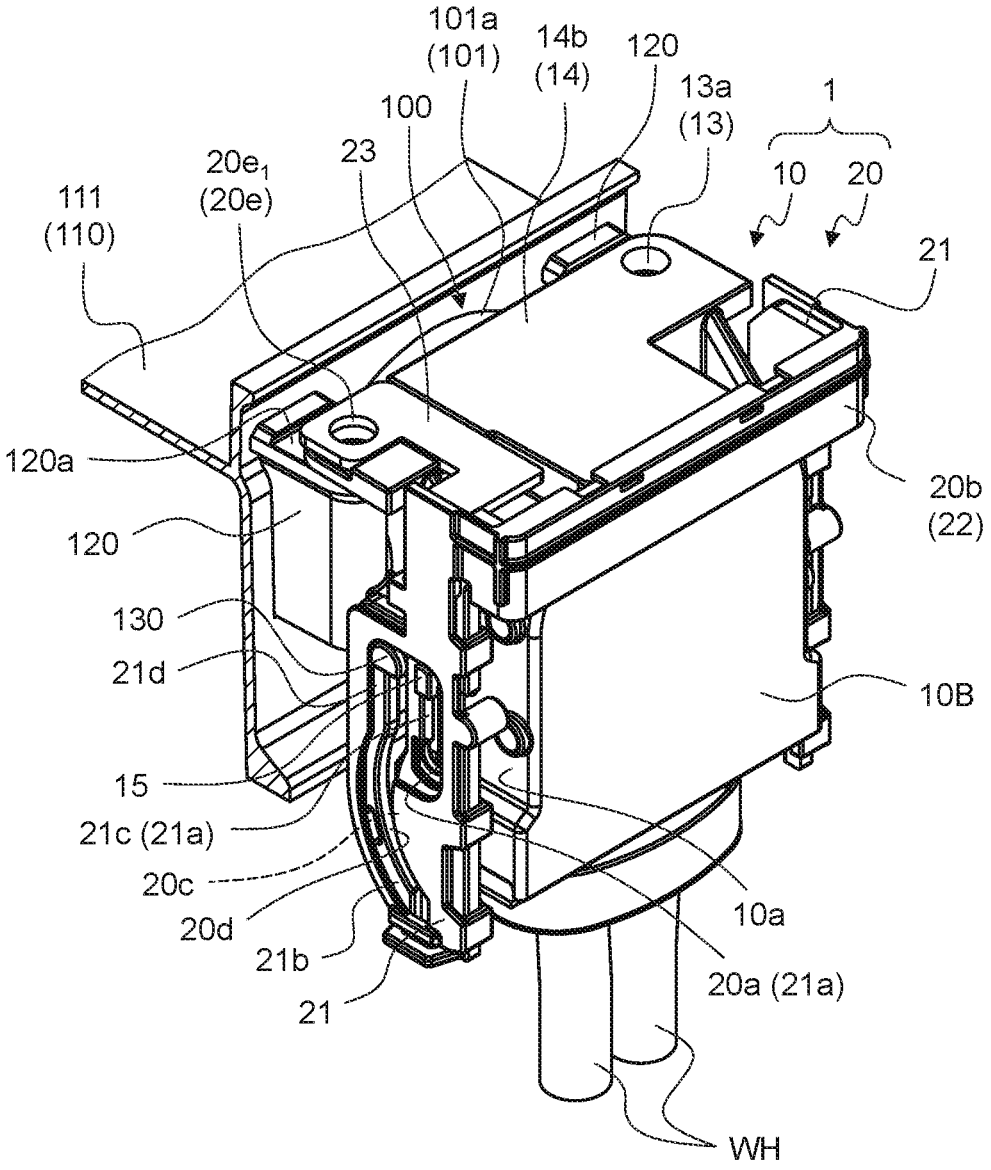
FIG. 10 is a perspective view illustrating a state where a pressing operation for fitting the connector to the lever member ends and a pulling operation for releasing the fitting of the connector does not start.
Figure 11:
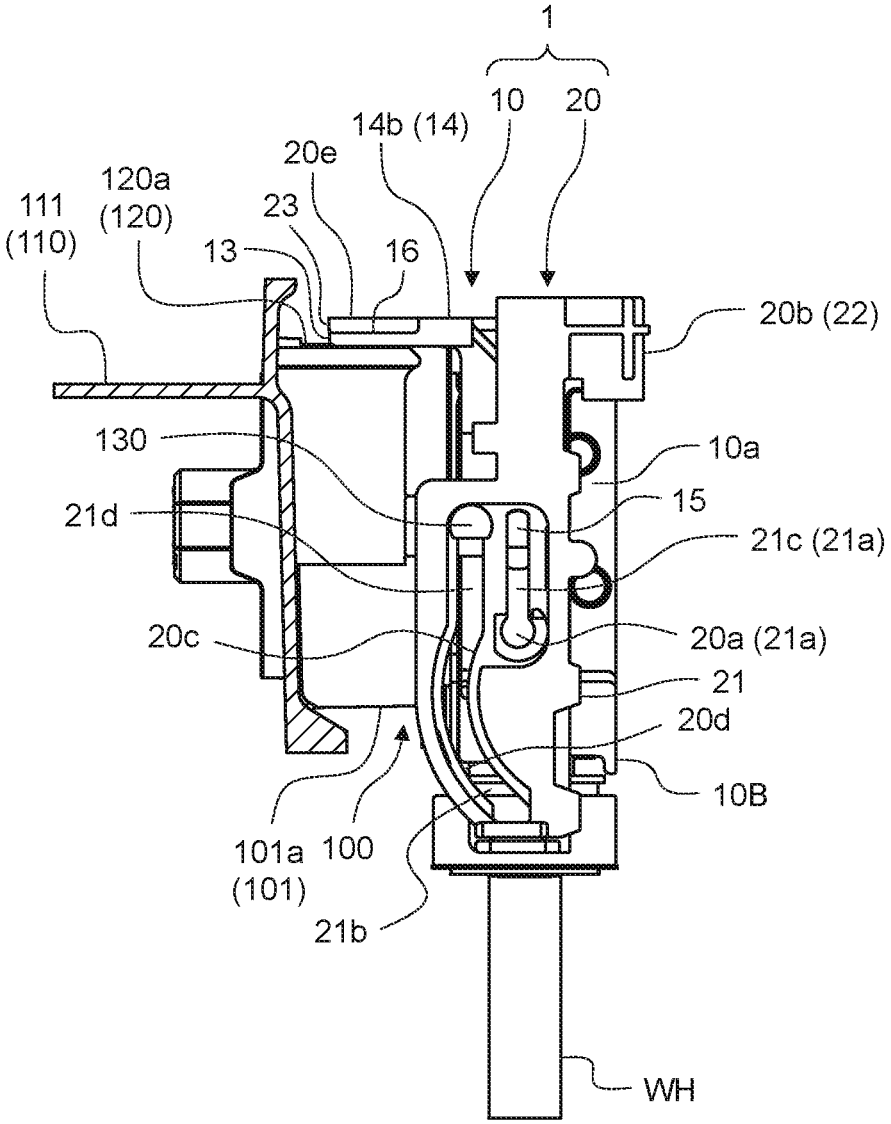
FIG. 11 is a side view illustrating a state where the pressing operation for fitting the connector to the lever member ends and the pulling operation for releasing the fitting of the connector does not start.

Each lever structure 21 is provided with a second guide portion 21*c* which communicates with the rotation fulcrum point portion 20*a* and is able to guide the rotation shaft 15 after the fitting between the connector fitting portion 12 and the counterpart fitting portion 101*a* is completed and a third guide portion 21*d* which communicates with the first guide portion 21*b* and is able to guide the target guide portion 130 in the same direction as the rotation shaft 15 after the fitting is completed (FIG. 5). The second guide portion 21*c* and the third guide portion 21*d* are formed so that the lever member 20 moves relative to the terminal storage body 10 to the fastening position of the target fixation portion 20*e* with respect to the target fixation portion 13 of the terminal storage body 10 and the counterpart fixation portion 120. Here, the fastening position becomes a third state position (hereinafter, referred to as a "third lever position") of the lever member 20 with respect to the terminal storage body 10 (FIGS. 10 to 12).

Here, one target fixation portion 20*e* is provided at a position near the connection body 22 in the lever member 20 of this example (FIG. 5). The target fixation portion 20*e* is disposed to be separated from the fixation portion 120 or the target fixation portion 13 at the second lever position and to be laminated on the fixation portion 120 or the target fixation portion 13 at the third lever position. The target fixation portion 20*e* of this example is provided at a piece body 23 extending from one lever structure 21. The piece body 23 includes a flat surface 23*a* which overlaps one end of the other flat surface 14*b* of the piece body 14 of the terminal storage body 10 (the shield shell 10B) at the third lever position and the lamination position is used as the target fixation portion 20*e* (FIG. 2). The target fixation portion 20*e* is provided with a penetration hole $\mathbf{20}e_1$ concentric with the penetration holes 13*a* and 121 at the third lever position. For example, the target fixation portion 13, the target fixation portion 20*e*, and the fixation portion 120 may be fastened by inserting male screw members (not illustrated) through the penetration holes 13*a*, $\mathbf{20}e_1$, and 121 and threading female screw members (not illustrated) to the male screw members. Further, the target fixation portion 13, the target fixation portion 20*e*, and the fixation portion 120 may be fastened by forming female screw portions on the inner peripheral wall of the penetration hole 121 and threading the male screw members B respectively inserted through the penetration holes 13*a* and $\mathbf{20}e_1$ to the female screw portions of the penetration hole 121. In this example, the latter case is exemplified (FIG. 12).

The lever member 20 of this example is moved relatively in the first orthogonal direction between the second lever position and the third lever position. For this reason, the second guide portion 21*c* and the third guide portion 21*d* are formed as penetration holes or grooves to extend in the extension direction of the lever structure 21. For example, the penetration hole 21*a* of this example extends in the extension direction of the lever structure 21 and among both ends in the extension direction, an end opposite to the connection body 22 (the lever operation portion 20*b*) is used as the rotation fulcrum point portion 20*a*. For this reason, the penetration hole 21*a* of this example uses a portion near the connection body 22 in relation to the rotation fulcrum point portion 20*a* as the second guide portion 21*c*. Further, each lever structure 21 includes a penetration hole extending in the extension direction and the penetration hole is used as the third guide portion 21*d*. The third guide portion 21*d* extends in the extension direction of the lever structure 21 toward the connection body 22 from the arrival position of the target guide portion 130 at the second lever position of the first guide portion 21*b*.

In this way, when the connection body 22 (the lever operation portion 20*b*) is pressed from the second lever position to the third lever position after the fitting in accordance with the connector fitting rotation operation is completed, the lever member 20 move relative to the terminal storage body 10 to a position where the target fixation portion 20*e* is laminated on the counterpart fixation portion 120 and target fixation portion 13 of the terminal storage body 10. For this reason, since the lever member 20 is fixed to the counterpart connector 100 or the electrical connection target 110 when the target fixation portion 20*e* is fastened to the counterpart fixation portion 120 and target fixation portion 13 of the terminal storage body 10 by screw-fixing, the positional deviation relative to the counterpart connector 100 or the electrical connection target 110 can be suppressed. Thus, since the transmission of the vibration generated in the electrical connection target 110 to the lever member 20 is suppressed, the rattling or relative positional change with respect to the terminal storage body 10 can be suppressed. Thus, the low insertion force connector 1 of the embodiment can improve the vibration resistance of the lever member 20 after the fitting is completed.

Further, in the low insertion force connector 1, the lever member 20 is attached to the terminal storage body 10 while being located at any one of the second lever position and the third lever position (FIG. 2) and the lever member 20 is moved to the first lever position (FIG. 3). Then, the low insertion force connector 1 is inserted into the counterpart connector 100 while the lever member 20 is located at the first lever position (FIG. 1). At the time of the inserting, the target guide portion 130 is inserted from a groove portion 24 (FIG. 3) of each lever structure 21 and the target guide portion 130 is guided to the first guide portion 21*b*.

Incidentally, the terminal storage body 10 may be provided with a positioning portion 16 where the target fixation portion 20*e* of the lever member 20 is disposed at the time of the fastening (FIG. 5). In this example, at the time of the fastening, the target fixation portion 20*e* of the lever member 20 is laminated on the target fixation portion 13 of the piece body 14 of the shield shell 10B. For this reason, the shield shell 10B is formed, for example, so that one end (the target fixation portion 13) having the target fixation portion 20*e* laminated thereon in the other flat surface 14*b* of the piece body 14 is recessed and the target fixation portion 20*e* of the lever member 20 is fitted into the recessed portion. Accordingly, when the target fixation portion 20*e* of the lever member 20 is operated from the second lever position to the third lever position to be fitted into the recessed portion, the penetration hole $\mathbf{20}e_1$ is disposed to be concentric with the penetration holes 13*a* and 121 corresponding to the fastening target. Thus, the recessed portion becomes the positioning portion 16 used when the target fixation portion 20*e* of the lever member 20 is laminated and thus the operability of the operation for pressing the lever member 20 from the second lever position to the third lever position can be improved. Further, the positioning portion 16 of this example is formed as a step with respect to the other flat surface 14*b* of the piece body 14 and the side wall can receive a rotation torque acting on the target fixation portion 20*e* at the time of the fastening. Thus, the positional deviation of the lever member 20 relative to the terminal storage body 10 at the time of the fastening can be suppressed.

Further, the second guide portion 21*c* and the third guide portion 21*d* may be formed to lock the rotation shaft 15 and the target guide portion 130 in a direction intersecting the axial direction of the male screw member B at the time of the fastening when the lever member 20 moves relatively to the fastening position (the third lever position). For example, the second guide portion 21*c* is formed to have a narrow gap with respect to the rotation shaft 15 in the connector insertion/extraction direction at the third lever position so that the relative positional deviation in the connector insertion/extraction direction therebetween is suppressed. Accordingly, since the lever member 20 can suppress the positional deviation relative to the terminal storage body 10 even between the second guide portion 21*c* and the rotation shaft 15 in addition to the target fixation portion 20*e*, it is possible to further suppress the rattling or relative positional change with respect to the terminal storage body 10. Further, the third guide portion 21*d* is formed to have a narrow gap with respect to the target guide portion 130 in the connector insertion/extraction direction at the third lever position so that the relative positional deviation in the connector insertion/extraction direction therebetween is suppressed. Accordingly, since the lever member 20 can suppress the positional deviation relative to the counterpart connector 100 or the electrical connection target 110 even between the third guide portion 21*d* and the target guide portion 130 in addition to the target fixation portion 20*e*, it is also possible to suppress the rattling or relative positional change with respect to the terminal storage body 10 from this point.

After the low insertion force connector according to the embodiment is fitted to the counterpart connector, the target fixation portion of the lever member is fastened to the target fixation portion of the terminal storage body and the fixation portion of the electrical connection target or the counterpart connector. That is, since the lever member is also fixed to the counterpart connector or the electrical connection target, a relative positional displacement with respect to the counterpart connector or the electrical connection target can be suppressed. Thus, the transmission of the vibration generated in the electrical connection target to the lever member is suppressed and the rattling or relative positional change with respect to the terminal storage body can be suppressed. Thus, the low insertion force connector can improve the vibration resistance of the lever member after the fitting is completed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A low insertion force connector comprising:

a terminal storage body that includes a terminal storage portion storing a terminal corresponding to a fitting target with respect to a counterpart terminal of a counterpart connector of an electrical connection target, a connector fitting portion fitted to a counterpart fitting portion of the counterpart connector, and a target fixation portion fixed to a fixation portion of the electrical connection target or the counterpart connector after the fitting between the connector fitting portion and the counterpart fitting portion is completed; and a lever member that includes a rotation fulcrum point portion attached to a rotation shaft of the terminal storage body to be rotatable, a lever operation portion serving as a force point portion during a lever operation, and an operation point portion fitting the terminal to the counterpart terminal while fitting the connector fitting portion to the counterpart fitting portion in a state where a target guide portion of the electrical connection target or the counterpart connector is slid to apply a force between the target guide portion and the operation point portion along with a rotation operation about the rotation fulcrum point portion as a rotation center in response to the rotation operation of the lever operation portion, wherein the lever member includes a target fixation portion which is fastened to the target fixation portion of the terminal storage body and the fixation portion after the fitting is completed.

2. The low insertion force connector according to claim 1, wherein the lever member includes the operation point portion and includes a first guide portion guiding the target guide portion along with a rotation operation about the rotation fulcrum point portion as a rotation center, a second guide portion which communicates with the rotation fulcrum point portion and is able to guide the rotation shaft after the completion of the fitting, and a third guide portion which communicates with the first guide portion and is able to guide the target guide portion in the same direction as the rotation shaft after the completion of the fitting, and the second guide portion and the third guide portion are formed so that the lever member moves relative to the terminal storage body to a fastening position of the target fixation portion of the lever member.

3. The low insertion force connector according to claim 2, Wherein the second guide portion and the third guide portion are formed to lock the rotation shaft and the target guide portion in a direction intersecting an axial direction of a fastening screw at the time of the fastening when the lever member moves relatively to the fastening position.

4. The low insertion force connector according to claim 1, wherein the terminal storage body includes a positioning portion on which the target fixation portion of the lever member is disposed at the time of the fastening.

5. The low insertion force connector according to claim 2, wherein the terminal storage body includes a positioning portion on which the target fixation portion of the lever member is disposed at the time of the fastening.

6. The low insertion force connector according to claim 3, wherein the terminal storage body includes a positioning portion on which the target fixation portion of the lever member is disposed at the time of the fastening.

* * * * *